US005180943A

United States Patent [19]

Kyushima

[11] Patent Number: 5,180,943

[45] Date of Patent: Jan. 19, 1993

[54] PHOTOMULTIPLIER TUBE WITH DYNODE ARRAY HAVING VENETIAN-BLIND STRUCTURE

[75] Inventor: Hiroyuki Kyushima, Hamamatus, Japan

[73] Assignee: Hamamatsu Photonics K.K., Shizuoka, Japan

[21] Appl. No.: 610,657

[22] Filed: Nov. 8, 1990

[30] Foreign Application Priority Data

Nov. 10, 1989 [JP] Japan ..... 1-293345

[51] Int. Cl.[5] ..... H01J 43/18; H01J 43/22

[52] U.S. Cl. ..... 313/535; 313/103 R; 313/105 R

[58] Field of Search ..... 313/535, 103 R, 105 R

[56] References Cited

U.S. PATENT DOCUMENTS

| | | | |
|---|---|---|---|
| 2,871,368 | 1/1959 | Bain | 313/104 X |
| 3,265,916 | 8/1966 | Vestal | 313/105 |
| 3,688,145 | 8/1972 | Coles | 313/535 |
| 4,117,366 | 9/1978 | Davis | 313/95 |
| 4,937,506 | 6/1990 | Kimura et al. | 313/533 |

FOREIGN PATENT DOCUMENTS

| | | |
|---|---|---|
| 1539957 | 10/1969 | Fed. Rep. of Germany . |
| 2504728 | 10/1982 | France . |
| 58-41617 | 9/1983 | Japan . |
| 63-91950 | 4/1988 | Japan . |
| 63-261664 | 10/1988 | Japan . |
| 64-71051 | 3/1989 | Japan . |

OTHER PUBLICATIONS

Journal of Physics E. Scientific Instruments, vol. 5, No. 10, 1972, pp. 964–966, A. F. J. Van Raan et al., "An experimental study of the response of a venetian blind type multiplier".

*Primary Examiner*—Sandra L. O'Shea

*Attorney, Agent, or Firm*—Sughrue, Mion, Zinn, Macpeak & Seas

[57] ABSTRACT

A venetian-blind type of photomultiplier tube comprising a photocathode for converting an incident light into photoelectrons, a venetian-blind type of dynode array comprising plural dynode rows arranged in a first direction, each of which comprises plural dynode elements arranged at a constant pitch in a second direction, each dynode element having a plate inclined to the first direction for emitting the secondary electrons, an anode array comprising plural anodes arranged in the second direction for collecting the secondary electrons emitted from the dynode array and outputting an amplified electrical signal corresponding to the light, and one or more electron converging electrodes for converging at least one stream of the photoelectrons and the secondary electrons and concentrically directing the converged stream to a predetermined portion of each of the dynode elements. The electron-flight control member may have various patterns such as a grid, strip, mesh and multi-aperture structures.

11 Claims, 5 Drawing Sheets

PHOTOMULTIPLIER TUBE WITH DYNODE ARRAY HAVING VENETIAN-BLIND STRUCTURE

BACKGROUND OF THE INVENTION

This invention relates to a photomultiplier tube, and more particularly to a photomultiplier tube having a venetian-blind type dynode.

A photomultiplier tube has been conventionally utilized to detect light having weak intensity into an amplified electrical signal. The photomultiplier tube basically includes a photocathode for converting light incident thereto into photoelectrons having information corresponding to the intensity of the light, a dynode array comprising plural dynode elements (vanes) for emitting secondary electrons at a predetermined multiplication rate upon incidence of an electron, an anode array for collecting the multiplied secondary electrons emitted from the dynode array and outputting an electrical signal to thereby convert the light having weak intensity into the amplified electrical signal corresponding thereto, and an envelope for accommodating the photocathode, the dynode array and the anode array.

In order to improve sensitivity and resolution of the photomultiplier tube, there have been hitherto proposed various structures for the dynode array such as a mesh type in which plural mesh-shaped dynodes are arranged in a longitudinal direction of the envelope, a venetian-blind type in which plural plate-shaped dynodes are arranged in the longitudinal direction of the envelope and so on.

The photomultiplier tube having the mesh type of dynode array is described in U.S. Pat. No. 4,937,506. In this type of photomultiplier tube, photoelectrons emitted from the photocathode are first bombarded against wires of a first mesh-shaped dynode to emit secondary electrons therefrom, and then the secondary electrons are successively bombarded against the successive mesh-shaped dynodes to multiply the secondary electrons. In this type of dynode array, wires constituting the mesh-shaped dynodes (that is, effective areas of the dynodes for receiving photoelectrons and emitting secondary electrons upon incidence of photoelectrons) are extremely small and narrow, and thus it is difficult to control a photoelectron stream emitted from the photocathode to concentrically impinge on the respective wires of the dynodes to improve multiplication efficiency. This photo-multiplier tube is equipped with a mesh-shaped electrode disposed in contact with the photocathode and kept fixedly at the same potential as the photocathode. This electrode is used to prevent spread of the photoelectrons emitted from the surface of the photocathode, but has no function of controlling the photoelectron stream to concentrically impinge to the wires (effective secondary electron emission areas of the dynodes).

The photomultiplier tube having the venetian-blind type of dynode array is shown in FIG. 1. The venetian-blind type of dynode array includes dynode elements each having a larger effective area for receiving photoelectrons and emitting secondary electrons upon incidence of the photoelectrons than the mesh type of dynode array because each dynode element of the venetian-blind type is of a plate type, so that the collection and emission efficiency of the electrons in the venetian-blind type of dynode array is better than that of the mesh type of dynode array.

As shown in FIG. 1 the photomultiplier tube of this type basically includes an elongated glass envelope 1 having a flat plate type light-incident surface 2 for passing an incident light therethrough to an inner side thereof, a photocathode 3 provided at the inner wall of the light-incident surface 2 for converting the incident light into photoelectrons, plural mesh electrodes $\mathbf{4}_1$ to $\mathbf{4}_n$ and plural dynode elements (vanes) 7 having a venetian-blind structure in that plural dynode rows $\mathbf{5}_1$ to $\mathbf{5}_n$ each comprising plural dynode elements arranged horizontally at a constant interval are vertically arranged at a constant interval as shown in FIG. 1, the mesh electrodes and the dynode rows being vertically and alternately arranged along a longitudinal direction of the glass envelope 1 to form a multi-stage arrangement, and an anode array comprising plural anodes 6 arranged horizontally in such a manner as to confront the dynode elements of the last dynode row (the bottom dynode row) at the last stage and are connected to terminals to output an external circuit (not shown).

Each dynode element comprises a plate type of electrode element having a shorter width (for example, a strip form), which is elongated in a direction vertical to the surface of the drawing. Each of the dynode elements is inclined to the longitudinal direction of the envelope 1 (in the vertical direction) as shown in FIG. 1. The inclining direction of the dynode elements is alternately changed at the respective stages. For example, all dynode elements of the dynode rows at the odd stages are inclined to the longitudinal direction of the envelope 1 by approximately 45 degrees in a clockwise direction, while all dynode elements of the other dynode rows at the even stages are inclined to the longitudinal direction of the envelope 1 by approximately 45 degrees in a counterclockwise direction (in the direction opposite to that of the odd stages).

In the photomultiplier tube thus constructed, the photocathode 3 is supplied with a voltage of 0 (volt), and a first pair of the mesh electrode ($\mathbf{4}_1$) and the dynode row ($\mathbf{5}_1$) at the first (uppermost) stage is supplied with approximately 300 (volts). A second pair of the mesh electrode ($\mathbf{4}_2$) and the dynode row ($\mathbf{5}_2$) at a second stage and the successive pairs of the mesh electrodes ($\mathbf{4}_3$ to $\mathbf{4}_n$) and the dynode rows ($\mathbf{5}_3$ to $\mathbf{5}_n$) at the successive stages are supplied with an incremental voltage which is successively increased by every 100 volts with respect to the voltage to be supplied to the first pair. The anode array is supplied with a highest voltage (for example, 1300 volts).

Upon incidence of light to a position 3*f* on the photocathode 3 in the venetian-blind type of photomultiplier tube, photoelectrons are emitted from the photocathode 3 and then are multiplied as secondary electrons by the first and successive dynode rows. Idealy, the multiplied secondary electrons should be detected by an anode 6*f* disposed at a position corresponding to the light-incident position 3*f*. However, in this type of photomultiplier tube, an electron stream of photoelectrons emitted from one point of the photocathode 3 spreads due to both of variation in energy of photoelectrons emitted from the surface of the photocathode 3 and a cosine-distributed emission angle thereof. The variation in energy of the photoelectrons is caused by difference in energy loss of the photoelectrons through a travel within the photocathode. That is, the photoelectrons are emitted in various positions different in depth of the photocathode (a photoelectron emitting layer), and thus lose different amounts of energy through collision with atoms from generation thereof till emission thereof from the surface of the photocathode. On the other hand, the cosine-distributed emission angle is caused by difference in emission angle of respective photoelectrons with respect to the surface of the photocathode. This spread in the electron stream disturbs all emitted secondary electrons from being detected by an anode corresponding to the light-incident point of the photocathode. In other words, some secondary electrons are not detected by the anode, but by other anodes disposed near to the anode as shown in FIG. 1, so that cross-talk is liable to occur.

A discriminating characteristic of this photomultiplier tube was estimated in the following manner: the light-incident surface 2 and the photocathode 3 are scanned with a spot light 10 of sufficiently-small diameter from a left side to a right side in FIG. 5, and an output signal is detected by only a specific anode 6*f* disposed at the center portion of the anode array.

FIG. 2 is a graph showing the discriminating characteristic obtained by the above manner, in which abscissa and ordinate represent a relationship between a position on the photocathode 3 to be scanned with a small spot of light and a relative value of an output signal from the anode 6*f*. In FIG. 2. a hatched portion of the graph represents a cross-talk occurring in the output signal, and particularly the hatched portion profiled by a dotted line B represents a cross-talk occurring in the conventional photomultiplier tube.

Further, in the conventional photomultiplier tube thus constructed, those secondary electrons which are upwardly emitted from the dynodes $\mathbf{5}_1$ at the first stage, particularly from upper portions 7*a* of the dynode elements 7 of the first dynode row $\mathbf{5}_1$, are upwardly passed through the first mesh electrode $\mathbf{4}_1$ and then returned to the dynode elements of the first dynode row $\mathbf{5}_1$. That is, some secondary electrons emitted at the upper portions 7*a* are not immediately and directly directed to the dynode elements at the second stage. On the other hand, other secondary electrons which are emitted from the lower portions 7*b* are immediately and directly directed to the dynode elements at the second stage with no disturbance. That is, the secondary electrons emitted from the upper portions 7*a* of the first stage are bombarded against the secondary dynode row later than those emitted from the lower portions 7*b* of the first stage, there occurs a difference in flight time between these two types of secondary electrons even though they are emitted from the same dynode element at the first dynode row $\mathbf{5}_1$. This difference in flight time of the secondary electrons emitted from the same dynode element causes a time scattering (time dispersion) of an output signal. The difference in flight time of the secondary electrons emitted from the first dynode row is approximately 3 nanoseconds, and causes the timing resolution to be degraded.

SUMMARY OF THE INVENTION

An object of this invention is to provide a Venetian-blind type of photomultiplier tube in which an output signal is obtained from an anode in one-to-one positional correspondence to a light-incident position on a photocathode.

Another object of this invention is to provide a venetian-blind type of photomultiplier tube in which photoelectrons emitted from a photocathode are convergently directed to a predetermined area of a dynode element without spread to effectively multiply secondary electrons without time scattering.

In order to attain the above objects, a Venetian-blind type of photomultiplier tube according to this invention comprises a photocathode for converting the incident light into photoelectrons, a venetian-blind type of dynode array for emitting secondary electrons with multiplication upon incidence of the photoelectrons thereto, the dynode array comprising plural dynode rows arranged in a first direction, each of the dynode rows comprising plural dynode elements arranged at a constant pitch in a second direction and each of the dynode elements having a plate inclined to the first direction for emitting the secondary electrons, an anode array comprising plural anodes arranged in the second direction for collecting the secondary electrons emitted from said dynode array and outputting an amplified electrical signal corresponding to the light, and one or more electron-flight control members for convergently and concentrically directing at least one stream of the photoelectrons and the secondary electrons to a predetermined portion of each of the dynode elements.

The electron-flight control member comprises an electron-flight control member having plural electron converging areas for converging the photoelectrons to the dynode array, the areas being arranged in the same pitch as the dynode row. Further, the electron-flight control member may have various electrode patterns such as grid, strip, mesh and aperture structures.

DETAILED DESCRIPTION OF THE INVENTION

Preferred embodiments of this invention will be described hereunder with reference to the accompanying drawings.

Figure 1:
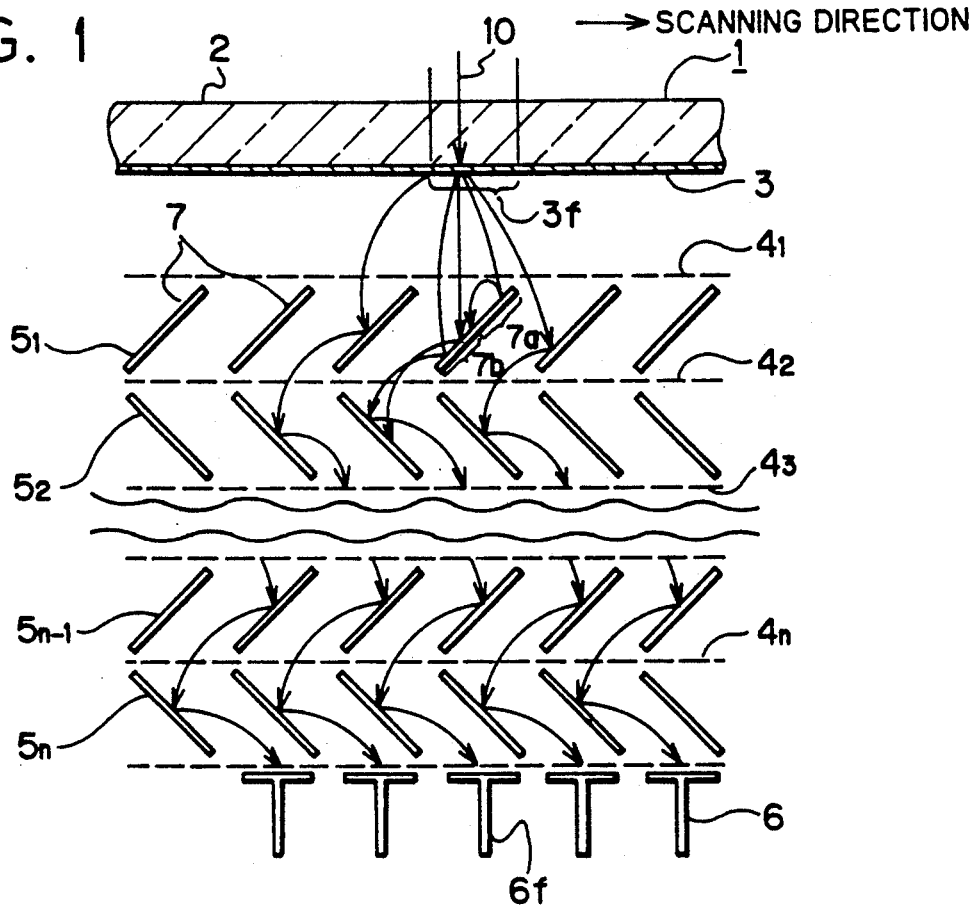
FIG. 1 shows a conventional venetian-blind type of photomultiplier tube.

A photomultiplier tube according to this invention is substantially of a venetian-blind type of photomultiplier tube, and has the substantially same construction as that of the conventional venetian-blind type of photomultiplier tube as shown in FIG. 1 except that it is further provided with an electron-flight control member such as an electron converging electrode. In FIGS. 3 to 8, the same elements of the photomultiplier tube of this invention as those of FIG. 1 are represented by the same reference numerals.

Figure 3:
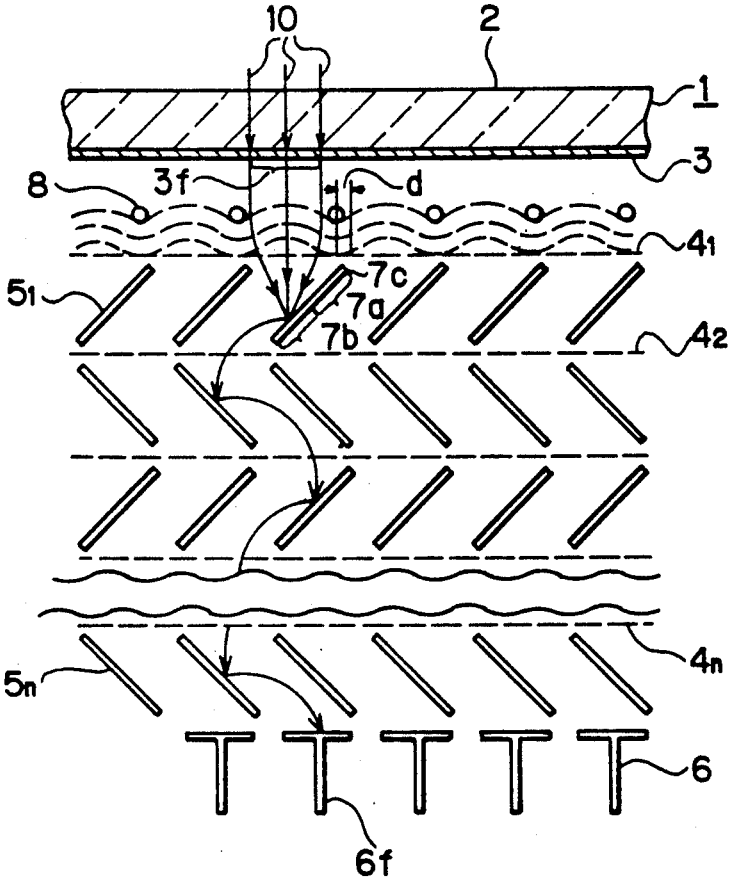
FIG. 3 shows a first embodiment of a venetian-blind type of photomultiplier tube according to this invention.

As shown in FIG. 3, the photomultiplier tube according to this invention comprises a glass envelope 1 having a light-incident surface 2, a photocathode 3 provided at the inner wall of the light-incident surface 2, plural mesh electrodes $4_1$ to $4_n$, venetian-blind type of dynode array ($5_1$ to $5_n$) and plural anodes 6.

Figure 4A:
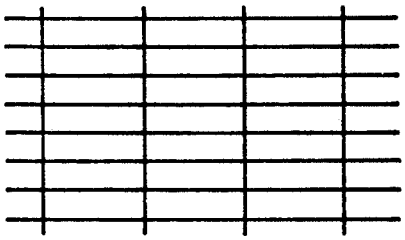
FIG. 4(A) to 4(D) show various electrode patterns of an electron-flight control member used in the photomultiplier tube according to this invention.
Figure 4B:
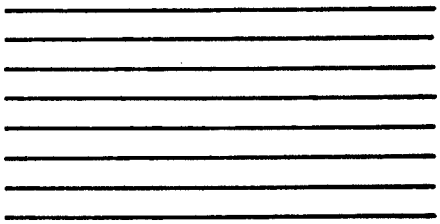
Figure 4C:
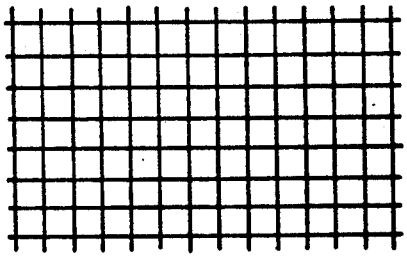
Figure 4D:
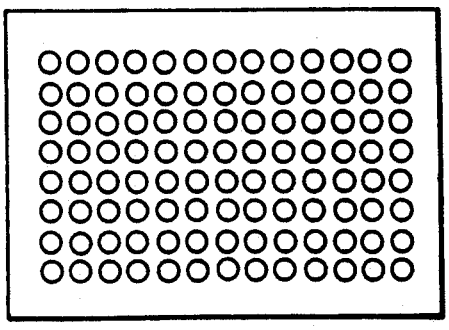

To the above construction, an electron-flight control member 8 for controlling a flight of an electron stream is further provided between the photocathode 3 and the first electrode $4_1$. The electron-flight control member comprises, for example, an electron converging electrode. The electron-flight control member 8 has an electrode structure in which electron converging portions thereof are periodically arranged at the same pitch as that of the dynode elements of the first dynode row, and is disposed above the first dynode row $5_1$. For example, the electron converging portions of the electron-flight control member 8 are arranged at 2.0 mm pitch when the dynode elements of the first dynode row $5_1$ are arranged at 2.0 mm pitch. Further, each electron converging portion may be located at a position which is shifted apart from one end (upper side) *7c* of each dynode element 7 toward the center thereof by a distance d corresponding to approximately one third to one-fourth of the width of the dynode element. This specific arrangement of the electron converging portions of the electron-flight control member 8 is important to effectively multiply the photoelectrons and prevent the time scattering of the output signal from the anode because the dynode element 7 has higher photoelectron-multiplying efficiency at the lower portion *7b* than at the upper portion *7a* thereof and the lower portion of the dynode element 7 is more effectively and sufficiently used in this specific structure. Insofar as the above structure is satisfied to the electron-flight control member 8, any electrode pattern may be adopted. For example, a grid pattern of 2 mm×7 mm in pitch as shown in FIG. 4(A), a strip pattern of 2 mm pitch as shown in FIG. 4(B), a mesh pattern of 2 mm×2 mm in pitch as shown in FIG. 4(C) and an aperture pattern having holes of 2 mm pitch may be formed by a well-known chemical or physical etching method. The wire width of the grid, strip and mesh patterns may be preferably 130 microns, and the diameter of each hole of the aperture pattern may be preferably 3 mm.

In the venetian-blind type of photomultiplier tube thus constructed, the photocathode 3 is supplied with a voltage of 0 (volt), the electron-flight control member 8 is supplied with a variable voltage of 0 to 100 volts and the first mesh electrode ($4_1$) and the first dynode row ($5_1$) at a first (uppermost) stage are supplied with approximately 300 (volts). The successive pairs of the mesh electrodes ($4_2$ to $4_n$) and the dynode arrays ($5_2$ to $5_n$) at the successive stages are supplied with an incremental voltage which is successively increased every 100 volts with respect to the voltage to be supplied to the first pair as the number of stage is increased. Further, the last mesh electrode $4_n$ and the last dynode row $5_n$ at the last stage are supplied with a voltage (300+100(n−1)) volts (ordinarily, 1200 volts for n=10), and the anode 6 is supplied with a voltage (300+100 n) volts (ordinarily, 1300 volts).

Upon incidence of light to the light-incident surface 2, photoelectrons are emitted from the photocathode 3 and then flight through the electron-flight control member 8 and the first mesh electrode $4_1$ to the first dynode $5_1$. Since the electron-flight control member 8 is supplied with a lower voltage than the first mesh electrode and the first dynode row (300 v), an electron lens effect as indicated by curved-dotted line of FIG. 3 occurs and thus the photoelectrons emitted from the photocathode 3 are convergently bombarded to a desired point of the lower portion *7b* of a dynode element of the first dynode array $5_1$. The converging flight of the photoelectrons toward the first dynode row is controlled by the variable voltage to be supplied to the electron-flight control member 8 (from 0 to 100 volts in this embodiment). The converged photoelectrons are successively multiplied through the respective dynode rows $5_1$ to $5_n$, and then finally collected by the corresponding anode *6f* without dispersion (cross-talk) of the photoelectrons to the other anodes.

Figure 5:
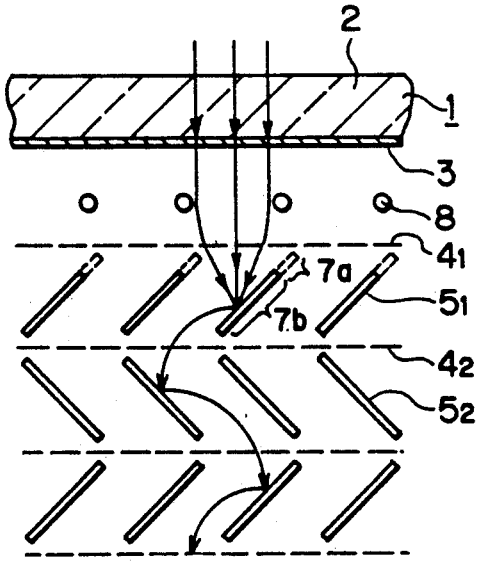
FIG. 5 shows a second embodiment of the venetian-blind type of photomultiplier tube according to this invention.

FIG. 5 shows a second embodiment of the photomultiplier tube of this invention. In this embodiment, the upper portion *7a* of each dynode element 7 of the first dynode row $5_1$ is cut off preferably by a length of one-third of the width of the dynode element, that is, each dynode element of the first dynode row $5_1$ comprises only the lower portion *7b* which is near to the second dynode row $5_2$, so that inequality of multiplication efficiency of the dynode array due to the upper portions of the dynode elements can be reduced.

Figure 6:
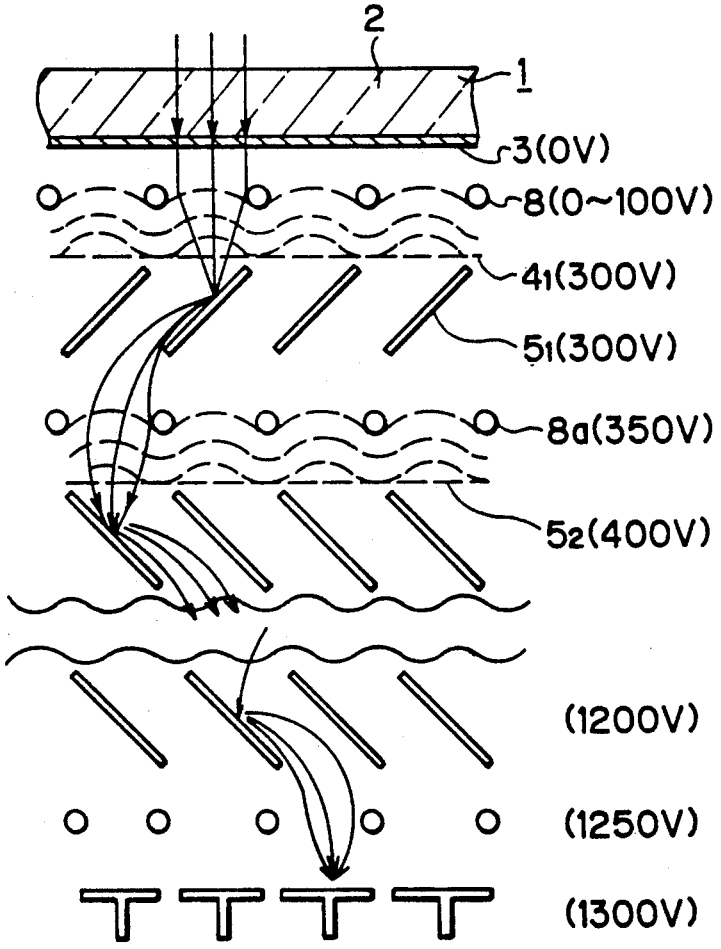
FIG. 6 shows third embodiment of the venetian-blind type of photomultiplier tube according to this invention.

FIG. 6 shows a third embodiment of the photomultiplier tube according to this invention. In this embodiment, in addition to the electron-flight control member 8, another electron-flight control member 8*a* is disposed between the second and third dynode rows $5_1$ and $5_2$. The electron-flight control member 8*a* is supplied with an intermediate voltage between those supplied to the first and second stages (mesh electrodes and dynode rows). In this case, for example, 350 volts is applied to the electron-flight control member 8*a*, to thereby form an electron lens between the second and third dynode rows $5_1$ and $5_2$ as shown in FIG. 6 and obtain a higher electron lens effect. The position where the electron-flight control member 8*a* is disposed, is not limited to that of FIG. 6, but may be any position between any one stage and a stage subsequent thereto and/or between the last stage and the anode array. In addition, two or more electron-flight control members may be individually provided at any positions between neighboring stages.

Figure 7:
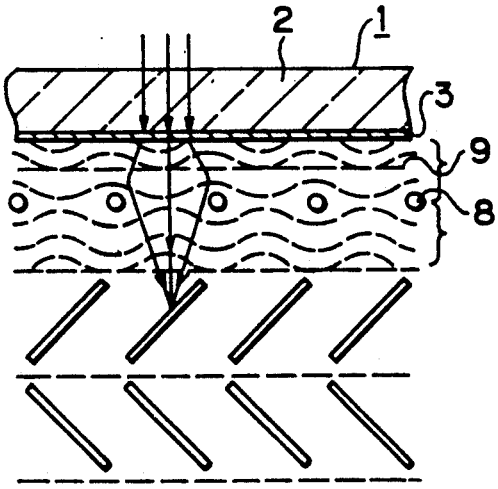
FIG. 7 shows a fourth embodiment of the venetian-blind type of photomultiplier tube according to this invention.

FIG. 7 shows a fourth embodiment of the photomultiplier tube according to this invention. In this embodiment, in addition to the electron-flight control member 8, a mesh type of acceleration electrode 9 is further provided between the photocathode 3 and the electron-flight control member 8. The acceleration electrode 9 is supplied with a sufficiently higher voltage than the voltage to be supplied to the electron-flight control member 8, for example, with 300 volts, so that those photoelectrons which are left untransited in the neighborhood of the photocathode 3 are rapidly accelerated and electrostatically directed to the first dynode row, and thus a higher electron converging effect is obtained.

Figure 8:
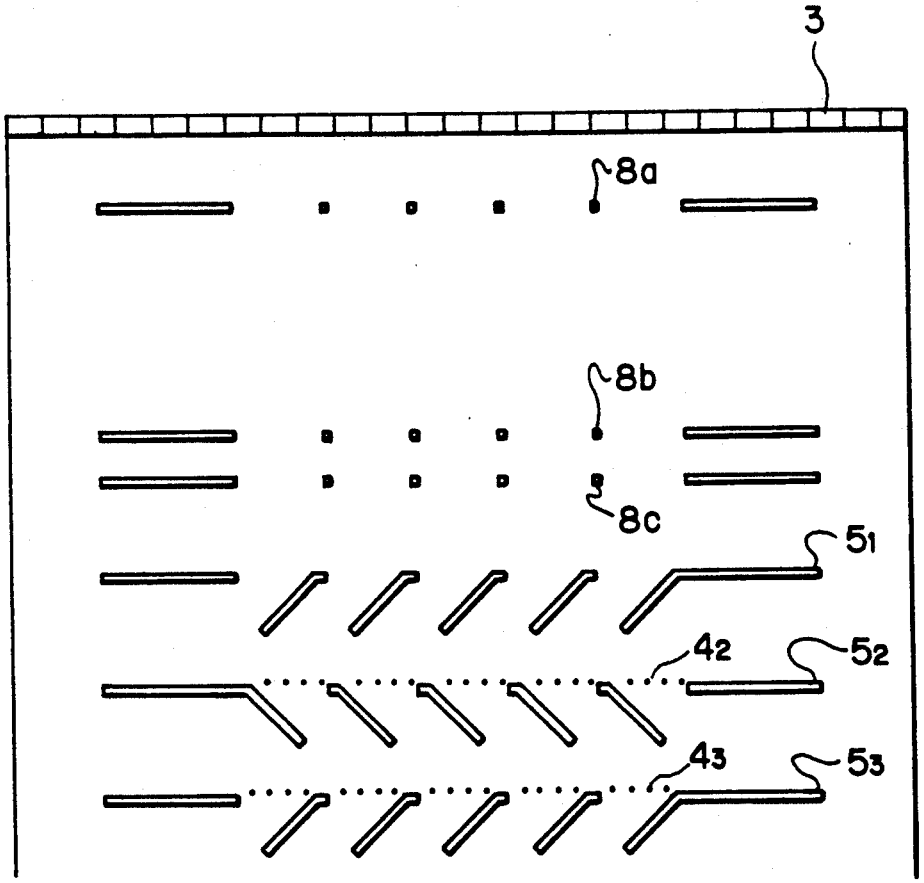
FIG. 8 shows a concrete construction of a fifth embodiment of the venetian-blind type of photomultiplier tube according to this invention.

FIG. 8 shows the concrete construction of a fifth embodiment of the photomultiplier tube according to this invention. In the first to fourth embodiments, one electron-flight control member is provided between the photocathode 3 and the first dynode row $5_1$. However, in this embodiment, three electron-flight control members 8*a* to 8*c* are provided between the photocathode 3 and the first dynode row $5_1$ in order to heighten the electron lens effect and improve the multiplication efficiency of the dynode array (in this embodiment, the first mesh electrode $4_1$ may be eliminated because one of the electron-flight control members serves as the mesh electrode). The first electron-flight control member 8*a* is disposed in the neighborhood of the photocathode 3 (for example, at a distance of 2.0 mm apart from the surface of the photocathode 3) and serves as the accelerating means for rapidly accelerating those photoelectrons which are left untransited in the neighborhood of the surface of the photocathode 3 and forcedly directing them toward the second and third electron-flight control members 8*b* and 8*c* to obtain higher electron multiplication efficiency. Further, the second and third electron-flight control members 8*b* and 8*c* are disposed near to the first stage. For example, as shown in FIG. 8, the second electron-flight control member 8*b* is disposed at a distance of 5 mm apart from the first member 8*a*, and the third electron-flight control member 8*c* is disposed between the second member 8*b* and the first dynode row $5_1$ and at a distance of 1 mm apart from the second member 8*b*. The third electron-flight control member 8*c* also serves as an accelerating means for accelerating the photoelectrons and directing them to the first dynode row $5_1$.

Figure 2:
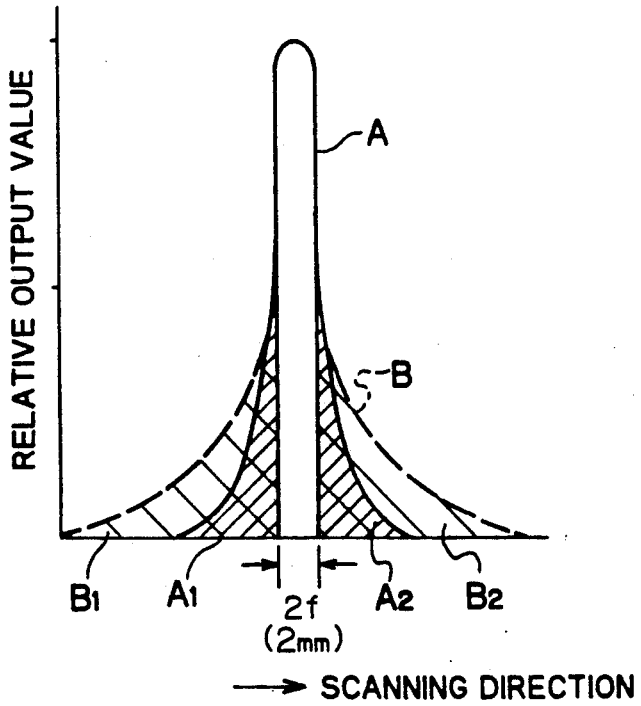
FIG. 2 is a graph showing discriminating characteristics of the conventional photomultiplier tube and the photomultiplier tube according to this invention.

According to the photomultiplier tube of this invention, the photoelectrons emitted from a position on the photocathode are concentrically and concentrically directed to a desired portion of each dynode element by the electron lens effect of the electron-flight control member without dispersion, and outputted as an electrical signal from the anode corresponding to the position with no time scattering. A portion as indicated by a solid line A of FIG. 2 is a discriminating characteristic of the photomultiplier tube according to this invention. A hatched cross-talk portion as represented by A1 and A2 are smaller in area that of the conventional photomultiplier tube as represented by B1 and B2.

Further, since the electron stream emitted from the photocathode and/or each dynode element is converged to substantially one point on the dynode element by the electron-flight control member, a difference in flight time between secondary electrons emitted from the upper and lower portions of the same dynode element can be reduced, and thus the timing resolution is more improved.

Still further, the dynode array of the photomultiplier tube according to this invention is simple in construction, and thus the photomultiplier tube is easily used and small in cost.

In the embodiments as described above, one to three electron-flight control members some of which have an electron accelerating function are provided between the photocathode and the first dynode row. However, four or more electron-flight control members may be provided in order to heighten the electron lens effect and improve accuracy of the electron-flight control and the multiplication of the secondary electrons.

What is claimed is:

1. A venetian-blind type of photomultiplier tube for converting an incident light into an amplified electrical signal, comprising:

a photocathode for converting the incident light into photoelectrons, a venetian-blind type of dynode array for emitting secondary electrons with multiplication upon incidence of the photoelectrons thereto, said dynode array comprising plural dynode rows arranged in a first direction, each of said dynode rows comprising plural dynode elements arranged at a constant pitch in a second direction and each of said dynode elements having a plate inclined to the first direction for emitting the secondary electrons;

an anode array comprising plural anodes arranged in the second direction for collecting the secondary electrons emitted from said dynode array and outputting an amplified electrical signal corresponding to the light; and one or more electron-flight control members for convergently and concentrically directing at least one stream of the photoelectrons and the secondary electrons to a lower portion of each of said dynode elements.

2. The photomultiplier tube as claimed in claim 1, wherein said electron-flight control member has an electron converging electrode having plural electron converging areas for converging the photoelectrons to said dynode array, said areas being arranged in the same pitch as that of said dynode elements of said dynode row.

3. The photomultiplier tube as claimed in claim 2, wherein said electron-flight control member comprises plural electrode wires arranged in a grid form, said wires serving as said electron converging areas.

4. The photomultiplier tube as claimed in claim 2, wherein said electron-flight control member comprises plural electrode wires in a strip form, said wires serving as said electron converging areas.

5. The photomultiplier tube as claimed in claim 2, wherein said electron-flight control member comprises plural electrode wires in a mesh form, said wires serving as said electron converging areas.

6. The photomultiplier tube as claimed in claim 2, wherein said electron-flight control member comprises a electrode plate having plural holes for convergently passing the photoelectrons therethrough, said holes being arranged in the same pitch as said dynode row.

7. The photomultiplier tube as claimed in claim 1, wherein at least one of said electron flight control members is provided between said photocathode and said dynode array.

8. The photomultiplier tube as claimed in claim 7, wherein at least one of said electron-flight control members is provided at any position between one dynode row and a subsequent dynode row thereto.

9. The photomultiplier tube as claimed in claim 1, further comprising an electron accelerating member provided in the neighborhood of said photocathode for accelerating the photoelectrons emitted from said photocathode and forcedly directing the photoelectrons toward said dynode array.

10. The photomultiplier tube as claimed in claim 9, wherein said electron accelerating member is supplied with a voltage higher than a voltage supplied to said electron-flight control member.

11. The photomultiplier tube as claimed in claim 9, wherein the voltage supplied to said electron-flight control member varies between the voltage supplied to an adjacent stage of said dynode array and an adjacent stage of one of said photocathode, said anode array and said electron accelerating member.

* * * * *